US005080374A

United States Patent [19]

Yu

[11] Patent Number: 5,080,374

[45] Date of Patent: Jan. 14, 1992

[54] ARTICLES OF PLAY FOR USE IN THE GAME OF HIT AND CATCH

[76] Inventor: Chien P. Yu, No. 15, Lane 251, Tung Yang Road, Tung Yang Li, Feng Yuan City, Taichung Hsien, Taiwan

[21] Appl. No.: 736,390

[22] Filed: Jul. 26, 1991

[51] Int. Cl.[5] ..... A63B 67/00

[52] U.S. Cl. ..... 273/346; 273/67 R; 273/327; 273/DIG. 30

[58] Field of Search ..... 273/327, 346, 412, 67 R, 273/318, 347, 328, DIG. 30

[56] References Cited

U.S. PATENT DOCUMENTS

| | | | |
|---|---|---|---|
| 578,491 | 3/1897 | Knowles | 273/328 X |
| 986,157 | 3/1911 | Fleming | 273/328 X |
| 1,617,243 | 2/1927 | Flanagan | 273/67 R X |
| 2,194,761 | 3/1940 | Maihack | 273/328 X |
| 3,366,386 | 1/1968 | Lindholm et al. | 273/67 R |
| 3,814,430 | 6/1974 | Leumi | 273/67 R X |
| 4,017,076 | 4/1977 | Bai | 273/346 |
| 4,735,420 | 4/1988 | Seidler | 273/346 X |
| 4,789,161 | 12/1988 | Waskelo | 273/327 |
| 4,995,617 | 2/1991 | Lee | 273/346 |

*Primary Examiner*—William H. Grieb
*Attorney, Agent, or Firm*—Beehler & Pavitt

[57] ABSTRACT

Articles of play including a racket having a handle portion and a board portion integrally formed together, the board portion including a plate, a flexible layer and a front layer coupled together, the front layer having all of its front surface defined by VELCRO materials, and a ball having all of its surface defined by VELCRO materials, and the ball can be hit by the plate of the racket and can be caught by the front layer of the racket.

4 Claims, 3 Drawing Sheets

ARTICLES OF PLAY FOR USE IN THE GAME OF HIT AND CATCH

BACKGROUND OF THE INVENTION

1. Field of the Invention

The present invention relates to an article of play, and more particularly to articles of play for use in the game of hit and catch.

2. Description of the Prior Art

One type of articles of play is disclosed in the U.S. Pat. No. 4,995,617 to Miryoung Lee, filed Mar. 8, 1990, entitled "ARTICLES OF PLAY FOR USE IN THE GAME OF CATCH". The articles can be used in the game of catch only and can not be used in the game of hit.

The present invention has arisen to mitigate and/or obviate the afore-described disadvantages of the conventional articles of play.

SUMMARY OF THE INVENTION

The primary objective of the present invention is to provide an article of play which can be used in the game of both hit and catch.

In accordance with one aspect of the invention, there is provided articles of play including a racket having a handle portion and a board portion integrally formed together, the board portion including a plate, a flexible layer and a front layer coupled together, the front layer having all of its front surface defined by a multitude of irregular filamentary formations, and a ball having all of its surface defined by a multitude of irregular filamentary formations, and the ball can be hit by the plate of the racket and can be caught by the front layer of the racket.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
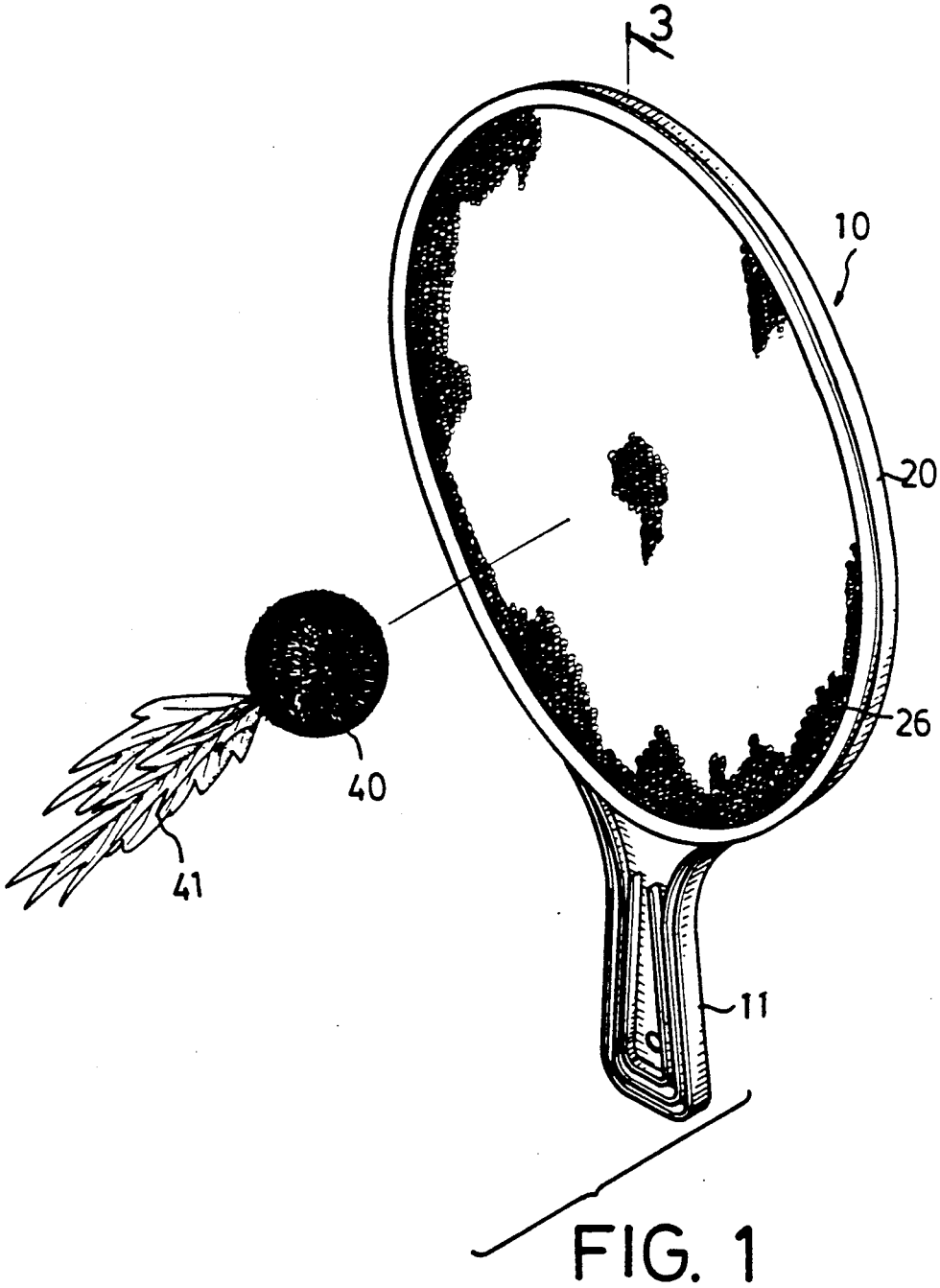
FIG. 1 is a perspective view of articles of play in accordance with the present invention.

Referring to the drawings and initially to FIGS. 1, the articles of play in accordance with the present invention comprises generally a racket 10 including a handle portion 11 and a board portion 20 which has one side covered with a multitude of irregular filamentary formations such as hook and loop materials, especially the so called VELCRO materials 26, and a ball 40 covered with a mating surface of irregular filamentary formations, such as VELCRO strips so that the ball 30 will adhere to the first side 21 of the board portion 20 when thrown by a person, such as a child. A feather 41 may be fixed to the ball 40 for directing the direction of the ball 40.

Figure 2:
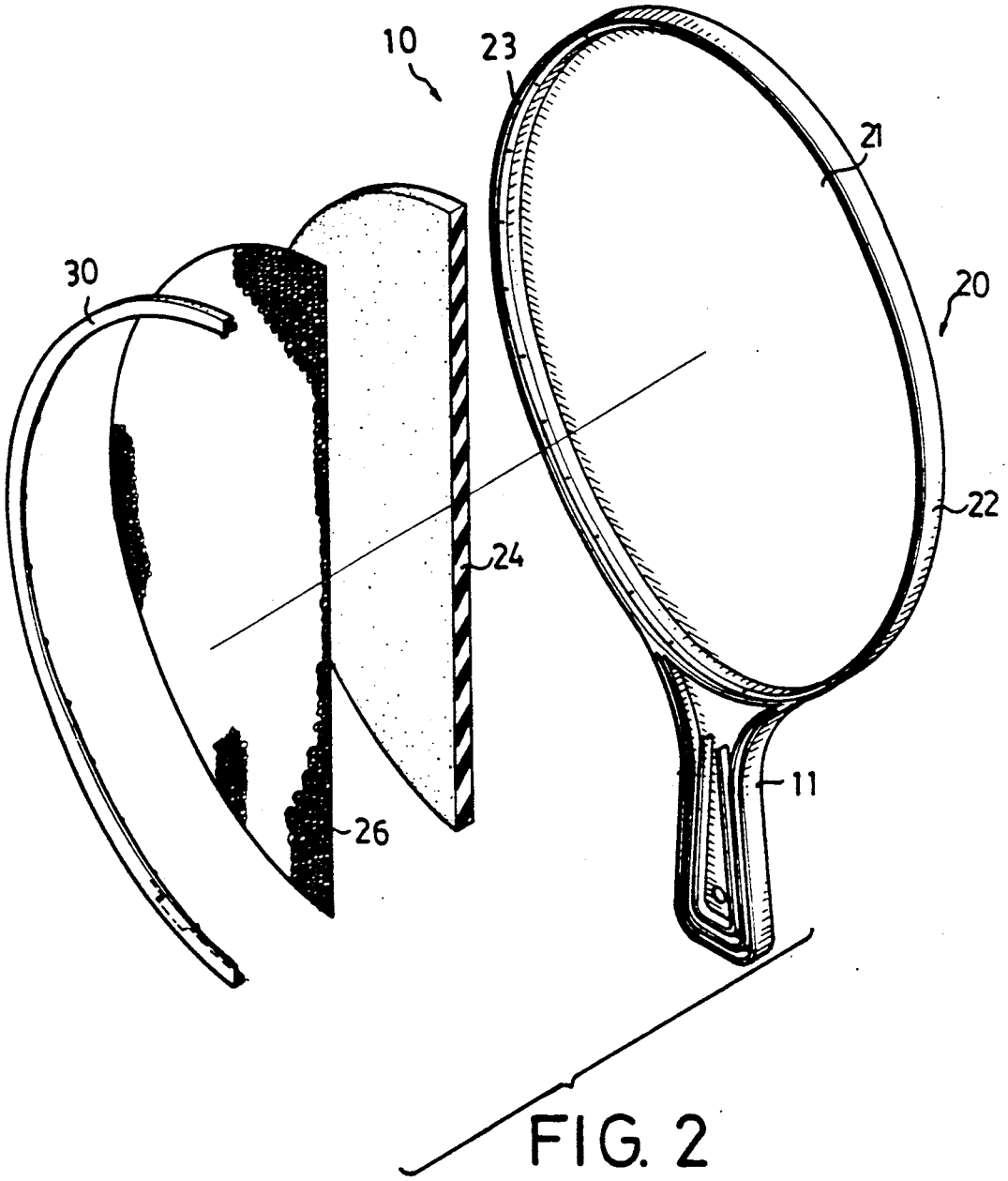
FIG. 2 is an exploded view of a racket.
Figure 3:
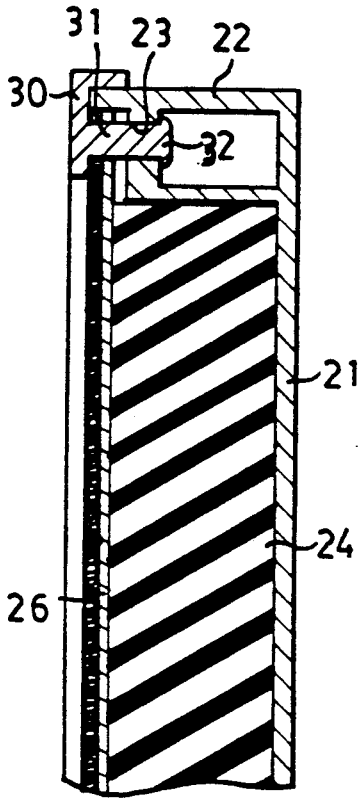
FIG. 3 is an enlarged cross sectional view taken along lines 3—3 of FIG. 1.

Referring next to FIGS. 2 and 3, the board portion 20 includes a plate 21 having a wall portion 22 extended from the peripheral edge thereof, a slot 23 is formed along the wall portion 22. A flexible layer 24 which is preferably made of foamable materials or of spongy materials is engaged in the wall portion 22. A front layer 26 of VELCRO materials is fixed on the flexible layer 24 by such as sewing operations. A frame 30 is engageable on the wall portion 22 of the board portion 20 and includes a projection 31 extended therealong and engageable in the slot 23 of the wall portion 22, the projection 31 has an enlarged head portion 32 formed along the free end portion thereof so that the frame 30 can be stably engaged to the wall portion 22 of the board portion 20. The plate 21 is made of relatively hard materials, such as plastic materials or acrylic materials etc., so that the ball 40 can be hit or struck by the plate 21 of the board portion 20.

In use, the ball 40 can be hit by the user, and then the ball 40 can be caught by the VELCRO layer 26 of the racket 10. Accordingly, the articles of play in accordance with the present invention can be used in the game of both hit and catch.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. Articles of play comprising a racket including a handle portion and a board portion integrally formed together, said board portion including a plate, a flexible layer and a front layer coupled together, said front layer having substantially all of its front surface defined by a multitude of irregular filamentary formations; and a ball having substantially all of its surface defined by a multitude of irregular filamentary formations; and said ball can be hit by said plate of said racket and can be caught by said front layer of said racket.

2. Articles of play according to claim 1, wherein said plate includes a wall portion extended from a peripheral edge thereof, said wall portion has a slot formed therealong, said flexible layer is engaged within said wall portion of said plate, and said racket further includes a frame having a shape corresponding to said wall portion and engageable on said wall portion of said plate, said frame includes a projection extended therealong and engageable with said slot of said wall portion so that said front layer and said flexible layer can be retained in place.

3. Articles of play according to claim 2, wherein said projection includes a head portion formed along a free end portion thereof for engagement with said slot of said wall portion so that said frame can be stably engaged to said wall portion of said plate.

4. Articles of play according to claim 1, wherein a feather is fixed to said ball for directing a direction of said ball.

* * * * *